US006386893B2

(12) United States Patent
Reum et al.

(10) Patent No.: US 6,386,893 B2
(45) Date of Patent: May 14, 2002

(54) SPARK PLUG BOOT ASSEMBLY AND HEAT SHIELD

(76) Inventors: Rex Reum; Vaughn V. Barnes, both of 2362 Railroad St., Corona, CA (US) 92880

( * ) Notice: Subject to any disclaimer, the term of this patent is extended or adjusted under 35 U.S.C. 154(b) by 0 days.

(21) Appl. No.: 09/847,507

(22) Filed: May 2, 2001

Related U.S. Application Data

(60) Provisional application No. 60/203,054, filed on May 4, 2000.

(51) Int. Cl.[7] ..... H01R 13/44
(52) U.S. Cl. ..... 439/125; 439/126
(58) Field of Search ..... 429/125, 126, 429/127, 128

(56) References Cited

U.S. PATENT DOCUMENTS 5,348,486 A * 9/1994 Tura, Jr. et al. ..... 439/125
6,305,954 B1 * 10/2001 Aluise, Sr. ..... 439/125

* cited by examiner

*Primary Examiner*—Tho D. Ta
(74) *Attorney, Agent, or Firm*—Rutan & Tucker LLP; Robert D. Fish

(57) ABSTRACT

A spark plug boot assembly has a boot with one end for receiving an ignition cable and another end for receiving a spark plug. A heat barrier surrounds the boot and includes an outer wall and an inner wall defining a cavity, and a thermal insulator is disposed within the cavity. Contemplated spark plug boot assemblies may further include a silicone coating between the inner wall of the heat barrier and the outer surface of the boot to reduce potential chafing of the boot.

15 Claims, 1 Drawing Sheet

SPARK PLUG BOOT ASSEMBLY AND HEAT SHIELD

This application claims the benefit of U.S. provisional application No. 60/203,054 filed May 4, 2000, incorporated herein in its entirety.

FIELD OF THE INVENTION

The field of the invention is automotive electric connectors.

BACKGROUND OF THE INVENTION

Spark plug boots are typically tubular elastomeric silicone members enclosing a portion of a spark plug and a potion of an ignition cable and frequently have a straight or generally L-shaped configuration. Despite their widespread use in many automobiles, problems with respect to thermal stability of the boots persist due to thermal degradation of the elastomeric silicone in the engine compartment, a problem that may especially be compounded by gasoline vapors and exhaust fumes. Where spark plug boots are thermally damaged, the boots are typically replaced which may incur significant costs, particularly where the boot is permanently coupled to the ignition cable. In order to reduce the frequency of replacing spark plug boots, various heat shields have been developed to protect the boot at least partially from thermal radiation.

For example, DeBolt teaches in U.S. Pat. No. 4,671,586 a spark plug shield and boot seal assembly in which a heat shield is rotationally interlocked with a boot seal assembly. DeBolt's heat shield further provides internal air flow passages and can advantageously be utilized as a boot seal removal tool for service. Although DeBolt's heat shield may facilitate installation and may improve the overall life span of a spark plug boot, some problems with DeBolt's heat shield remain. For example, by providing internal air flow passages, the temperature in the boot proximal to the internal air flow passages may disadvantageously increase due to thermal convection within the passages. Moreover, thermal conduction along the heat shield may increase the temperature in areas of the heat shield that are not directly exposed to a heat source, thereby potentially reducing the thermal protection.

In another example, U.S. Pat. No. 5,348,486 to Tura and Germ, a thin metallic heat shield is stamped from a sheet metal and wrapped around the boot to form a heat shield. Tura's heat shield engages with the hex of the metal shell of the spark plug via a pair of ears that protrude from the heat shield. Forming a heat shield from a sheet metal generally allows relatively simple fabrication and may potentially reduce costs. However, problems similar to the problems of DeBolt's heat shield remain. Most importantly, Tura's heat shield merely provides a passive deflector that deflects heat radiation, but tends to fails to provide insulation from heat convection and thermal conduction within the heat shield. Still further, both Tura 's and DeBolt's heat shields are generally inflexible, thereby eliminating the advantage of having a somewhat flexible spark plug boot.

Although various heat shields for spark plug boot assemblies are known in the art, all or almost all of them fail to provide protection from heat convection and thermal conduction within the heat shield. Therefore, there is still a need to provide spark plug boot assemblies with improved heat shields.

SUMMARY OF THE INVENTION

The present invention is directed to a spark plug boot assembly in which a heat barrier surrounds a boot having ends for receiving an ignition cable and a spark plug, respectively. The heat barrier has an outer wall and an inner wall that are coupled together to define a cavity, with a thermal insulator disposed in the cavity. The inner wall of the heat barrier snugly engages with the outer surface of the boot, and may further comprise a silicon coating that faces the outer surface of the boot.

In one aspect of the inventive subject matter, the thermal insulator may comprise ceramic wool, microporous amorphous silica, fiberglass, or polymeric foam. While it is generally contemplated that the outer and inner walls are fabricated from metal, it is preferred that the metal is stainless steel foil having a thickness of about 0.002–0.005 inch and it is even more preferred that the outer wall is corrugated.

In another aspect of the inventive subject matter, both the boot and the heat barrier can be L-shaped, and it is particularly preferred that the heat barrier is electrically coupled to a metal portion of a spark plug to electrically ground the heat barrier.

Various objects, features, aspects and advantages of the present invention will become more apparent from the following detailed description of preferred embodiments of the invention, along with the accompanying drawing.

DETAILED DESCRIPTION

Figure 1:
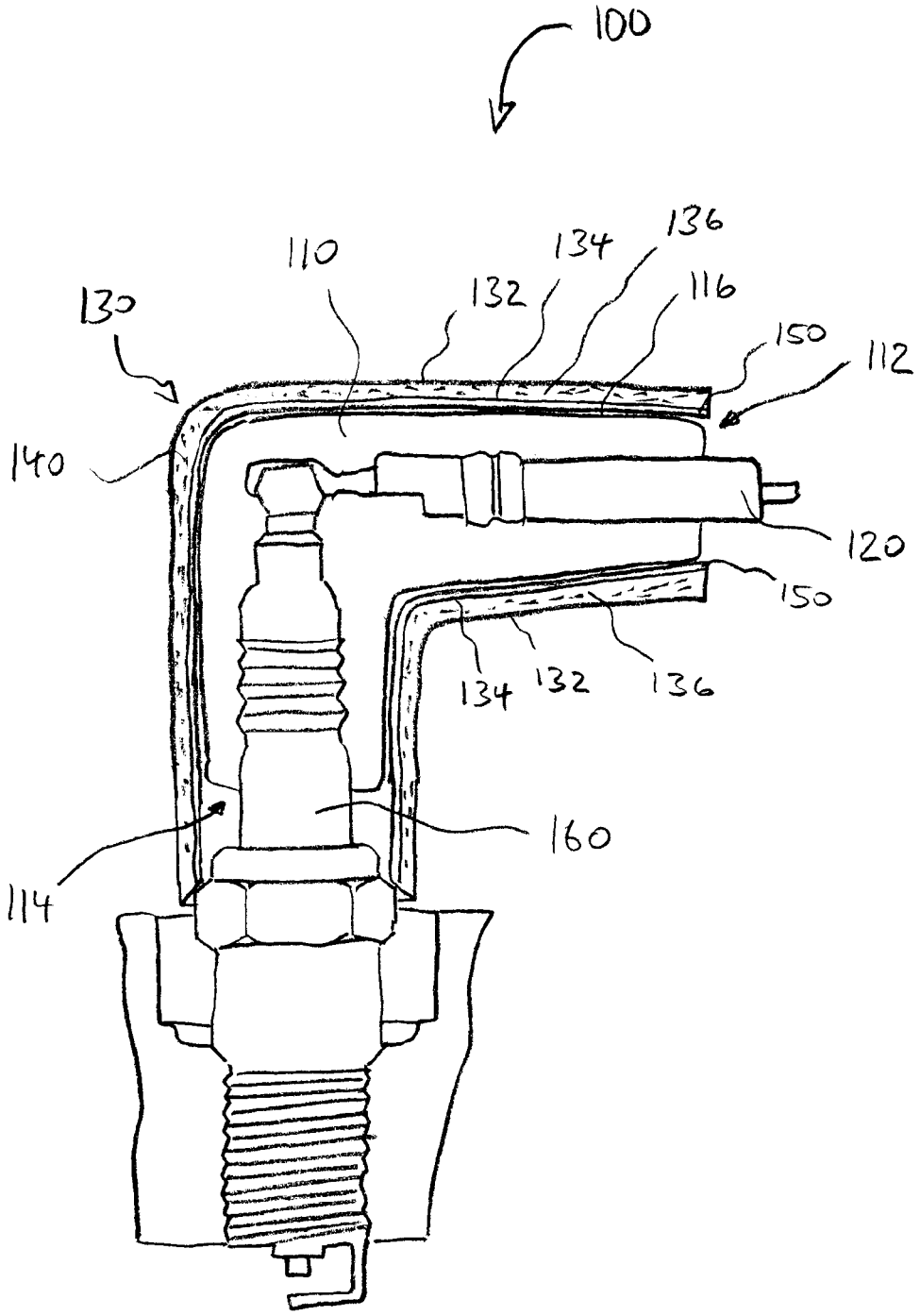
FIG. 1 is a schematic vertical cross sectional view of a spark plug boot assembly according to the inventive subject matter.

In FIG. 1, an exemplary spark plug boot assembly 100 has a boot 110 having a first end 112 for receiving an ignition cable 120, a second end 114 for receiving a spark plug 160, and an outer boot surface 116. The heat barrier 130 has an outer wall 132 and an inner wall 134. The outer and inner walls are coupled together to define a cavity 136, and a thermal insulator 140 is disposed within the cavity. The heat barrier 130 surrounds the boot such that the inner wall 134 snugly engages with the outer boot surface 116. An optional silicone coating 150 may be disposed on the outer surface of the inner wall 134 facing the outer boot surface 116.

With respect to the boot 110 it is generally contemplated that appropriate boots are elastomeric tubular boots, preferably fabricated from silicone. There are many spark plug boots known in the art and it is contemplated that material, shape and size of known spark plug boots are not limiting to the inventive subject matter presented herein. For example, contemplated boots may have a generally L-shaped or straight configuration as frequently found in many automobiles. Alternatively, the angle formed between the spark plug receiving portion and the ignition cable receiving portion may be greater than 90°, including angles between 91°–120°, 120°–150°, and 151°–180° to accommodate to a particular engine configuration and/or to minimize space requirements of the spark plug boot assembly. Similarly, where angles of less than 90° are desirable, it is contemplated that angles between 75°–89°, 60°–75°, and 30°–60° are appropriate.

The first end of the boot is preferably sized and dimensioned to sealingly engage with and around the ignition cable, while a middle portion of the boot preferably provides an intermediate cavity portion that accommodates a socket terminal at the end of the ignition cable. As used herein, the term "sealingly" refers to providing a barrier to fluids and gases at atmospheric pressure. Likewise, it is preferred that the second end of the boot is sized and dimensioned to sealingly engage around a ceramic insulator of the spark plug. Both the spark plug and the ignition cable are of conventional design and configuration. Furthermore, the material of contemplated boots need not be restricted to silicone, but may include various alternative materials, including natural and synthetic polymers, rubber and rubber composites, which may or may not include metal, mineral or fiberglass reinforcements.

The outer wall 132 and the inner wall 134 of the heat barrier 130 are preferably fabricated from a metal, and a particularly preferred metal is a stainless steel foil having a thickness of about 0.002–0.005 inch. It should be appreciated, however, that various alternative materials are also appropriate, including corrosion resistant metals, metal alloys and inorganic materials. For example, where resistance to corrosion at a reduced weight is desirable, aluminum may be employed as a suitable material. Alternatively, where high mechanical strength and high temperature resistance is required, titanium or titanium alloys may be utilized. In still other cases where flexibility and/or electrically insulating properties are particularly desirable, materials such as woven glass- or mineral fiber may be advantageously employed.

With respect to the thickness of the outer and inner wall, it is contemplated that the thickness of the walls may vary considerably depending on the particular mechanical properties of the material and the desired strength. For example, in cases where the outer wall is be exposed to mechanical stress, a wall thickness of 0.005–0.050 inch and thicker may be appropriate. On the other hand, where no mechanical stress is expected or where flexibility to at least some degree is required, relatively thin walls with a thickness of 0.001–0.003 inch and less may be appropriate. It is further contemplated that where the outer wall is relatively thin (e.g., a stainless steel foil with a thickness of less than about 0.006 inch) the outer wall may be corrugated to help improve the mechanical strength. It is generally contemplated that the heat barrier has a shape that is at least in part complementary to the shape of the boot. Thus, contemplated boot and heat barrier may have a straight, angled, or L-shaped configuration.

In still further aspects of the inventive subject matter, both the inner and outer walls may include additional materials. For example, the outside of the inner wall may have a silicone coating facing the outer boot surface to minimize friction and potential mechanical degradation of the outer boot surface due to vibration and friction between the inner wall and the outer boot surface. Additionally, or instead of the silicone coating, the outside of the inner wall may have a dielectric barrier disposed between the outer boot surface and the inner wall of the heat barrier. Appropriate materials for the dielectric barrier include polyimide films, polyester films, polytetrafluoroethylene films, and it is contemplated that the thickness for such dielectric barrier films is generally in the range of 0.001–0.005 inches. Depending on the particular dielectric material, the barrier may be sprayed or powder coated onto the inner wall of the heat barrier.

The outer and inner wall are preferably fabricated by providing a two inner half shells and two outer half shells, and cutting the shells to a desired length. The shells may then be connected by spot or laser welding the end portions of thereof to the walls of a generally ring shaped end piece having a U-profile. Alternatively, and especially where the spark plug boot assembly has an angled configuration, the inner and outer walls may be stamped out from a flat metal foil, and bent into shape as generally outlined in U.S. Pat. No. 5,348,486 to Tura and Germ. Both inner and outer walls may then be connected together by welding, cramping or otherwise mechanically securing the walls together. The size of the cavity may vary depending on the particular thermal insulation requirements, but it is generally contemplated that the cavity extends at least 30% of the length of the boot along a longitudinal direction, and has a height between the outer and inner walls of at least 1/16". It should be appreciated, however, that many other lengths are also appropriate, including lengths between 30%–60%, 60%–80%, and 80%–100% of the length of the boot along a longitudinal direction. For example, the cavity may extend beyond the length of the boot along the wire. Similarly, while the height between the outer and inner walls is at least 1/32", it is contemplated that many heights other than 1/32" are also appropriate, including heights less than 1/32", between 1/32"–1/16", 1/16"–1/8", 1/8"–1/4", 1/4"–1/2", and more.

Where desired, the heat barrier may be electrically coupled to a metal portion of the spark plug to electrically ground the heat barrier. Grounding the heat barrier may be performed in a variety of ways, including providing a pair of snap type metal tongues extending from the heat barrier as described in U.S. Pat. No. 4,497,532 to Bezusko et al. Alternatively, a spring based electrical connection may be provided as described in U.S. Pat. No. 5,163,838 to Tura and Bezusko. The boot may be attached to the heat barrier by merely pressing the boot into the heat barrier, or where the boot has an angled configuration by folding precut pieces of outer and inner walls around the boot in a manner similar to the one described in U.S. Pat. No. 5,348,486 to Tura and Germ.

With respect to the thermal insulator, it should be appreciated that many thermal insulator materials are appropriate, including ceramic wool, microporous amorphous silica, fiberglass, polymeric foam, or any reasonable combination thereof. Particularly preferred materials include flame resistant materials such as mineral fibers and pyro-ceramics. In cases where flame resistance or retardance is not especially required, aerogels or polymers may advantageously be employed. The insulator material may be introduced into the cavity 136 by first forming an insulator layer on one of the inner or outer wall of the heat barrier (e.g., by spraying or gluing) and then adding the corresponding other wall, or by mechanically forcing the insulator material into the preformed cavity between the outer and inner wall.

It should be especially appreciated that the heat barriers in spark plug boot assemblies according to the inventive subject matter will act as an active heat barrier by providing a thermally insulated space extending both in a longitudinal and perpendicular direction relative to the spark plug and ignition cable. While prior art heat shields generally deflect ambient heat, prior art heat shields tend to fail to protect the boot, spark plug and from heat that is conducted through the metal shield.

Thus, specific embodiments and applications of improved spark plug assemblies have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A spark plug boot assembly, comprising:

a boot having a first end for receiving an ignition cable, a second end for receiving a spark plug, and an outer boot surface;

a heat barrier having an outer wall and an inner wall, wherein the outer wall and the inner wall are coupled together to define a cavity, and wherein the heat barrier surrounds at least part of the boot such that at least part of the inner wall snugly engages with the outer boot surface; and a thermal insulator disposed in the cavity.

2. The spark plug boot assembly of claim 1 wherein the inner wall has a silicone coating facing the outer boot surface.

3. The spark plug boot assembly of claim 2 wherein the thermal insulator comprises ceramic wool.

4. The spark plug boot assembly of claim 2 wherein the thermal insulator comprises a microporous amorphous silica.

5. The spark plug boot assembly of claim 2 wherein the thermal insulator comprises fiberglass.

6. The spark plug boot assembly of claim 2 wherein the thermal insulator comprises polymeric foam.

7. The spark plug boot assembly of claim 2 wherein the boot is L-shaped.

8. The spark plug boot assembly of claim 2 wherein the heat barrier is L-shaped.

9. The spark plug boot assembly of claim 2 wherein the heat barrier is electrically coupled to a metal portion of a spark plug to ground the heat barrier.

10. The spark plug boot assembly of claim 2 wherein the outer wall and the inner wall are fabricated from a metal.

11. The spark plug boot assembly of claim 10 wherein the metal is a stainless steel foil.

12. The spark plug boot assembly of claim 11 wherein the stainless steel foil has a thickness of about 0.002–0.005 inch.

13. The spark plug boot assembly of claim 11 wherein the stainless steel foil in the outer wall is corrugated.

14. The spark plug boot assembly of claim 2 further comprising a dielectric barrier.

15. The spark plug boot assembly of claim 14 wherein the dielectric barrier is located between the outer boot surface and the inner wall of the heat barrier.

* * * * *